US006880359B2

(12) United States Patent
Pearson et al.

(10) Patent No.: US 6,880,359 B2
(45) Date of Patent: Apr. 19, 2005

(54) FLOW-THROUGH ROTARY DAMPER PROVIDING COMPARTMENT SELECTIVITY FOR A MULTI-COMPARTMENT REFRIGERATOR

(75) Inventors: James E. Pearson, Downers Grove, IL (US); Thomas J. Davern, St. Charles, IL (US); Paul H. Tuma, Lombard, IL (US)

(73) Assignee: Robertshaw Controls Company, Richmond, VA (US)

( * ) Notice: Subject to any disclaimer, the term of this patent is extended or adjusted under 35 U.S.C. 154(b) by 0 days.

(21) Appl. No.: 10/620,104

(22) Filed: Jul. 15, 2003

(65) Prior Publication Data

US 2005/0011218 A1 Jan. 20, 2005

(51) Int. Cl.[7] ..... F25D 17/04
(52) U.S. Cl. ..... 62/408; 62/186; 62/407
(58) Field of Search ..... 62/132, 186, 187, 62/407, 408

(56) References Cited

U.S. PATENT DOCUMENTS 5,899,083 A * 5/1999 Peterson et al. ..... 62/186
6,121,526 A * 9/2000 Kobori et al. ..... 188/291
6,240,735 B1 * 6/2001 Kolson et al. ..... 62/187

* cited by examiner

*Primary Examiner*—Melvin Jones
(74) *Attorney, Agent, or Firm*—Leydig, Voit & Mayer, Ltd.

(57) ABSTRACT

A flow-through rotary damper assembly providing highly efficient, essentially laminar fluid flow therethrough is provided. The rotary damper assembly includes a cylindrical outer body and a cylindrical inner body that are rotatable in relation to one another. The outer body defines apertures in relation to one another to allow fluid flow without requiring fluid direction change. The inner body defines a flow passage having inlet and outlet apertures that may be aligned with the apertures of the outer body to allow fluid flow therethrough, or may be rotated out of alignment to block fluid flow. The outer body includes an aperture on one end to allow fluid flow to a third compartment. The inner body also includes an end aperture that may be aligned therewith. The damper provides selectable fluid flow between each of the compartments depending on the relative position of the cylindrical inner body member.

30 Claims, 9 Drawing Sheets

FLOW-THROUGH ROTARY DAMPER PROVIDING COMPARTMENT SELECTIVITY FOR A MULTI-COMPARTMENT REFRIGERATOR

FIELD OF THE INVENTION

The present invention relates generally to temperature control systems for multi-compartment refrigerators, and more particularly to dampers and damper control systems for regulating the temperature of multi-compartment refrigerators having, e.g. fresh food, crisper, and freezer compartments.

BACKGROUND OF THE INVENTION

In a typical multi-compartment refrigerator there are several methods for controlling the temperature of each of the compartments. It is common practice for the refrigeration system, i.e. the compressor, evaporator, fan, etc., to directly cool the freezer compartment. Air from the freezer compartment is directed to the fresh food compartment by means of an opening from the freezer to the fresh food compartment. Air is throttled in this opening by means of some type of air damper control. The damper has traditionally been a manually operated mechanism, which can be adjusted by the user to vary the freezer temperature. The fresh food temperature is generally controlled by a thermostat which senses the fresh food compartment temperature. The thermostat governs the operation of the compressor and evaporator fan. The resulting freezer temperature is a function of the fresh food compartment set point temperature and the position of the manual damper. It is generally known that this type of control system is not ideal for temperature stability of the freezer, especially when the outside temperature changes and the fresh food set point temperature is changed. The advantage of this system is that it is very inexpensive to produce.

A less traditional means of control used currently in only approximately 15% of standard refrigerators produced in the United States is to cycle the compressor using a thermostat that senses the freezer temperature. The air flow to the fresh food compartment is attenuated by a modulating air damper control. This control uses a refrigerant charged bellows that expands and contracts in response to the temperature of the fresh food compartment. The bellows movement is then used to drive a door, located in the air flow stream, to attenuate air flow to the fresh food compartment. The movement of the door is very predictable, thus allowing this device to be offered on a production basis. This type of control system allows for more accurate temperature control for both compartments than the method described above. Outside temperature variance and door openings are better compensated using this system.

The principal drawback for such a system is cost. Manufacturers positioning certain product as "high performance" are the users of this type of system. Further, despite the improved efficiency of this more expensive system, the controlled temperature of both compartments still varies over a substantial range of temperatures. This is due to the passive nature of both of these control functions, which is characterized by greater operating tolerances as well as limited response time. Another problem of such a damper system, which also plagues the less expensive systems, is icing of the damper door. The buildup of ice on the damper door can prevent proper operation of the temperature control. Such ice buildup may result in the damper door being prohibited from opening or closing, thus upsetting the normal control of temperature in both compartments.

The growing use of microcontroller and microprocessor based controls in residential appliances now makes them cost effective for use in residential refrigerators. They provide increased control accuracy, faster response, and lower refrigeration cycle times, all of which result in higher efficiency and lower operating costs to the consumer. Within these electronic control type systems, however, there remains a need for mechanical damper assemblies. To further improve the operating efficiency of the electronic controls these mechanical damper assemblies must preferably be capable of operating in a gated manner; i.e. in an open/closed sequence at a given duty cycle, as determined by the electronic control. The ideal damper assembly therefore must itself be capable of fast response as well as efficient air flow characteristics.

One such mechanical damper system that overcomes the problems existing with the prior systems is disclosed in U.S. Pat. No. 6,240,735, to Kolson et al., entitled ROTARY DAMPER ASSEMBLY, and assigned to the assignee of the instant application, the teachings and disclosure of which is hereby incorporated in their entireties by reference thereto. Advantageously, this patent discloses a rotary damper assembly for controlling the flow of a fluid. The rotary damper assembly includes inner and outer hollow cylinders, each having one or more side wall apertures. The inner cylinder is nested within the outer cylinder in a manner to permit relative axial rotation of the cylinders about a common longitudinal axis. This inner cylinder receives the fluid flow at an axial inlet. The flow of fluid out of the assembly is in a radial direction through the side wall apertures. The size of the opening formed by the side wall apertures is proportional to the degree of alignment of the cylinder apertures.

While the Kolson et al. rotary damper assembly provides a great advance over the prior damper systems, overcoming many of the problems existing therewith, it is designed to control the flow of fluid between two compartments. However, high end, specialty, and newer refrigerator models being designed today include multiple compartments to store fresh food. A crisper drawer or compartment inside the main fresh food compartment is one such example. While present models typically allow a user to manually set a damper between the main fresh food compartment and the crisper drawer, such temperature control suffers from the very problems that lead to the use of controlled dampers between the freezer and the fresh food compartment, e.g. wide temperature variances. This problem is especially acute with the crisper drawer or compartment as its frequency of being opened compared to the main refrigerator door of the fresh food compartment is much less. However, the temperature control is generally driven by the fresh food compartment temperature. As such, the crisper drawer may become over chilled, which may damage vegetables and fruits stored therein.

The Kolson et al. rotary damper also requires a directional change in the fluid flow through the assembly. That is, the Kolson et al. damper redirects the flow of the fluid from an axial flow to a radial flow therein. This results in increased fluid turbulence, which reduces the efficiency of the fluid exchange between the two compartments. Refrigerator manufacturers are very concerned about power consumption, and are very competitive in reducing power consumption. They are also under tremendous pressure from the Department of Energy to make incremental power consumption reductions. As such, any improvements in the efficiency of any aspect of the refrigerator is highly sought after.

Therefore, there continues to exist a need in the art for a damper system that provides better temperature stability of all of the temperature controlled compartments of a refrigerator, including the freezer compartment, the fresh food compartment, and the crisper drawer or compartment, while reducing the cost and power consumption and increasing the overall efficiency of the system.

BRIEF SUMMARY OF THE INVENTION

In view of the above, the present invention provides a new and improved rotary damper assembly. More particularly, the present invention provides a new and improved rotary damper assembly that provides temperature control for the freezer and multiple fresh food compartments, each of which may be maintained at different temperatures. Further, the present invention provides a new and improved rotary damper assembly that increases the efficiency of fluid flow by providing essentially laminar flow therethrough.

One feature of the present invention is improved efficiency of fluid transfer through the damper assembly. A further feature of the present invention is selectable and gated operation between a full open and a full closed position to allow variable fluid flow between selected compartments.

According to the present invention, a damper assembly for controlling the flow of a fluid includes concentric inner and outer hollow cylindrical members, the inner cylindrical member being adapted to receive and direct the fluid flow and to be nested within the outer cylindrical member in a manner which permits relative axial rotation of the members about a common longitudinal axis. In one embodiment, each member has side wall apertures for providing a fluid flow path therethrough, whereby the flow of fluid through the assembly is proportional to the degree of alignment of the apertures. In an alternate embodiment, the inner cylindrical member includes flow control members forming a flow path therethrough in relation to the side wall apertures of the outer cylindrical member. In another embodiment, the cylinders also include an end aperture at a longitudinal end thereof for providing another or an alternate fluid flow path therethrough. The apertures are so arranged such that selectable flow through the apertures may be achieved.

In further accord with the present invention, the inner cylinder includes fluid sealing members disposed thereon which restrict the fluid flow path through the assembly to the side wall apertures. In still further accord with the present invention the fluid sealing members are disposed circumferentially along each longitudinal end of the inner cylinder and axially along a length of the cylinder.

In yet still further accord with the present invention, the damper assembly includes a source of rotational motive power which is adapted to engage with and rotate the inner cylindrical member relative to the outer cylindrical member. The source of motive power is selectably actuated to rotate the inner cylindrical member to establish a degree of registration of the apertures as necessary to provide a desired amount of fluid flow through the assembly to the desired compartment(s). In yet still further accord with the present invention the outer cylindrical member is stationary relative to axial rotation of the inner cylindrical member. In yet still further accord with the present invention, the damper assembly includes a position control device which de-actuates the source of motive power in response to the rotational position of the inner cylindrical member at one or more selected locations corresponding to a desired relative positioning of the side and/or end wall apertures. In still further accord with the present invention, the source of motive power provides full slew axial rotation of the inner cylindrical member between a full flow position corresponding to substantial registration of the cylindrical side and/or end wall apertures, and a minimum flow position corresponding to no overlap of any portion of the apertures.

The rotary damper assembly of the present invention provides high efficiency and selectable modulation of fluid flow through the assembly and is highly suitable for use with different electronic flow control applications, including refrigeration equipment. This efficiency is achieved through the dual cylindrical member configuration which provides slew rates which are compatible with gated operation as well as good fluid seal characteristics in the full closed position. Increases in efficiency are realized through the essentially laminar fluid flow through the assembly between the main compartments between which the assembly is installed.

Other features and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
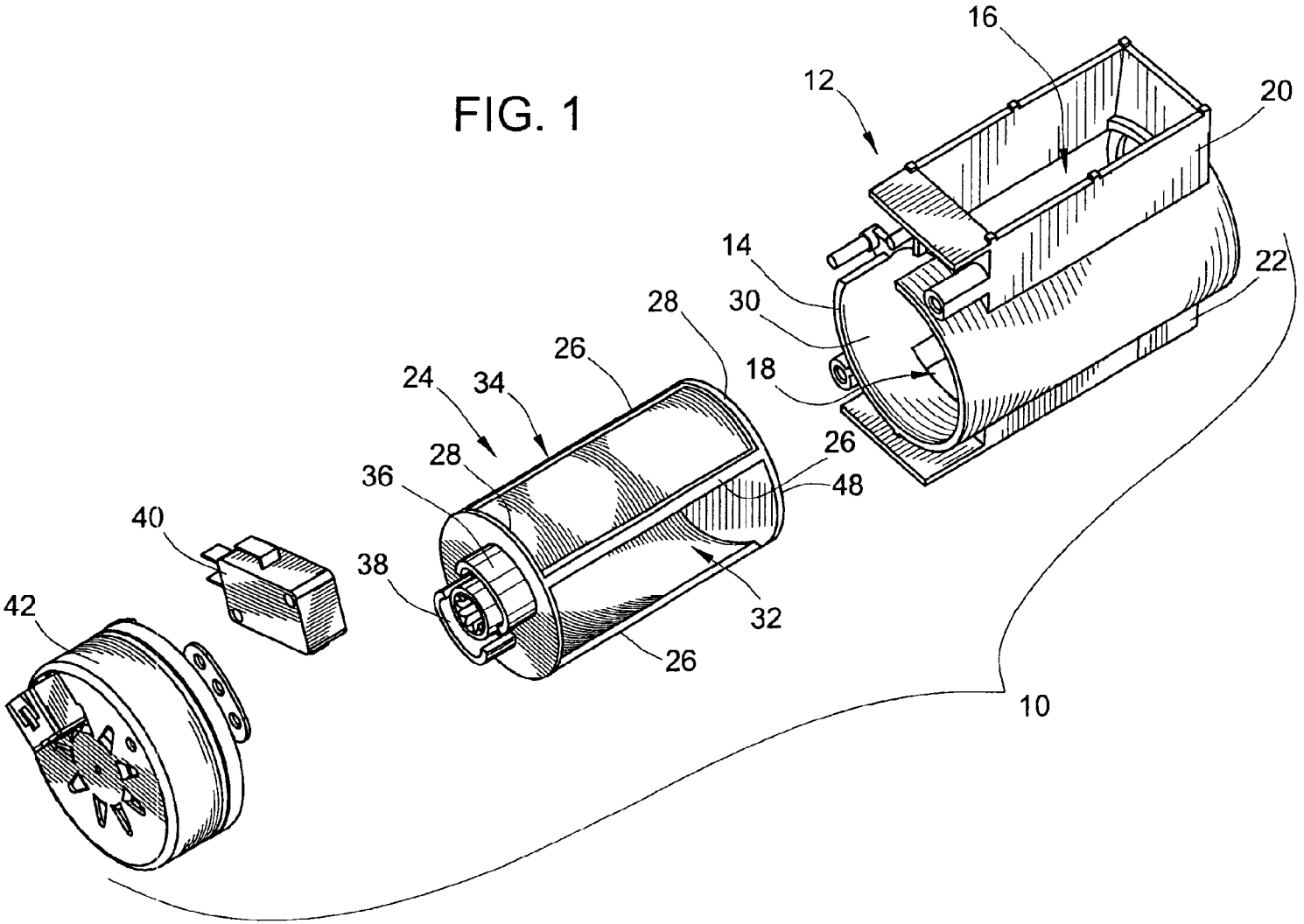
FIG. 1 is an exploded isometric illustration of one embodiment of a flow-through rotary damper constructed in accordance with the teachings of the present invention.

Turning now to the drawings, an exploded isometric illustration of an embodiment of the flow through rotary damper of the present invention is provided in FIG. 1 to which specific reference is now made. In this embodiment, the rotary damper assembly 10 includes a stationary housing 12. The housing includes a cylindrical outer body member 14 defining inlet and outlet apertures 16, 18 in its outer cylindrical wall. In a preferred embodiment, these two apertures 16, 18 are positioned relative to one another such that fluid flowing into one of the apertures could flow directly out of the other aperture without experiencing a direction of flow change. As will be discussed more fully below, this provides the highest efficiency flow through the rotary damper assembly. However, one skilled in the art will recognize that other installations may necessitate a different orientation of the two apertures 16, 18 relative to one another, such installations experiencing a slightly less efficient flow of fluid there through.

The housing 12 also preferably includes inlet and outlet plenums 20, 22 that allow for flush mounting of the assembly 10 between two flat wall portions such as may exist between the fresh food compartment and the freezer compartment of a refrigerator. Further, these plenums 20, 22 may be contoured to fit a particular installation for the rotary damper assembly 10, and are not constrained to any particular configuration. Indeed, one skilled in the art will recognize that these plenums 20, 22 may be separate and apart from the cylindrical outer body member 14 depending on the installation requirements.

The flow through rotary damper assembly 10 of the present invention also includes a cylindrical inner body member 24, which is inserted into and rotatably accommodated within the cylindrical outer body member 14. The cylindrical inner body member 24 includes a plurality of longitudinal fluid sealing members 26 and circumferential fluid sealing members 28 that cooperate with the inner surface 30 of the cylindrical outer body member 14 to prevent or restrict the ability of fluid to flow through the assembly 10 between the outer 14 and inner 24 body members.

The cylindrical inner body member 24 also defines inlet and outlet apertures 32, 34 in the sidewalls thereof. In a preferred embodiment, these two apertures 32, 34 are aligned in proximity with one another such that fluid flowing into one of the apertures may continue to flow without direction change out of the other aperture. As discussed above, this greatly increases the efficiency of the flow through rotary damper of the present invention over prior rotary dampers that required the fluid flow to change direction within the assembly. Also as discussed above, if the location of apertures 16, 18 is varied from this most efficient orientation, the location of apertures 32, 34 may also be reoriented to allow for the two sets of apertures to come into alignment when fluid flow through the assembly is desired.

The cylindrical inner body member 24 may also include location control cam surfaces 36, 38 that cooperate with a position sensing control mechanism, such as microswitch 40, to provide position feedback information to the rotary damper control. Such control may utilize simple cutoff circuitry that cuts the power to the source of rotational mode of power, such as motor 42 when the desired damper position has been reached, or may utilize more sophisticated electronic control to allow variable orientation between the two sets of apertures 16/18 and 32/24 to provide variable flow through control within the assembly 10. As will be recognized by those skilled in the art, more or fewer location control cam surfaces may be employed to provide multiple position sensing and control of the position of the cylindrical inner body member 24 relative to the cylindrical outer body member 14. Additionally, one skilled in the art will recognize that the location control cam surfaces 36, 38 may be dispensed with entirely if other location control mechanisms are utilized. For example, if motor 42 is a timer motor, that self regulates its running time, the position of the cylindrical inner body member 24 may be controlled via timing as opposed to actual position sensing. Additional position control mechanisms may also be employed as are well known in the art such as, the inclusion of a shaft encoder, etc. The particular choice of location control mechanisms is not a limiting factor in the present invention. Further, the motor 42 may also embody a stepper motor or a DC motor. As is apparent from the forgoing and the following, the motor 42 may be unidirectional or bi-directional.

Figure 2:
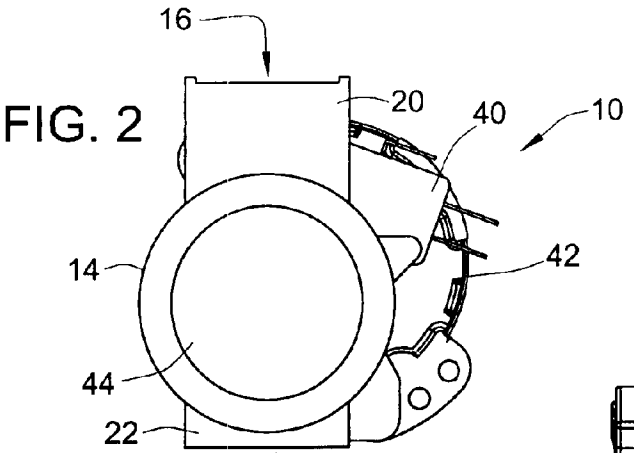
FIG. 2 is an end view illustration of one embodiment of the rotary damper of FIG. 1.
Figure 3:
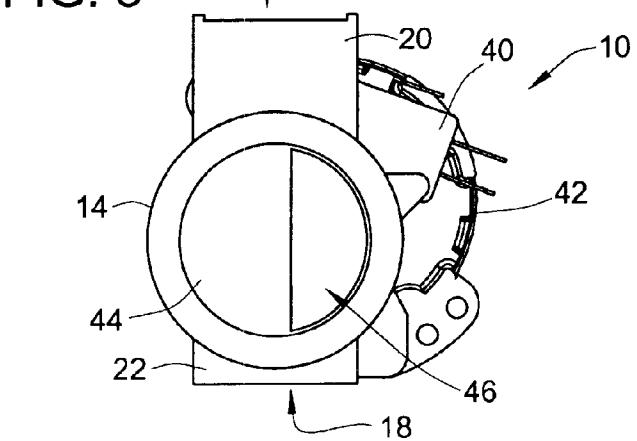
FIG. 3 is an end view illustration of an alternate embodiment of the rotary damper of FIG. 1.

As may be seen from the end view illustration of FIG. 2, the end wall 44 of the cylindrical outer body member 14 may be closed to prevent the flow of any fluid in an axial direction. Alternatively, as illustrated in FIG. 3, the end wall 44 may include an aperture 46 that would allow the flow of fluid there through. In order to enable such axial flow, the end wall 48 of the cylindrical inner body member 24 must also include an aperture 50 (see FIGS. 5*a–c*). In such an embodiment, the fluid flow paths into and out of the assembly 10 are shown by the fluid flow arrows in FIG. 4.

Figure 4:
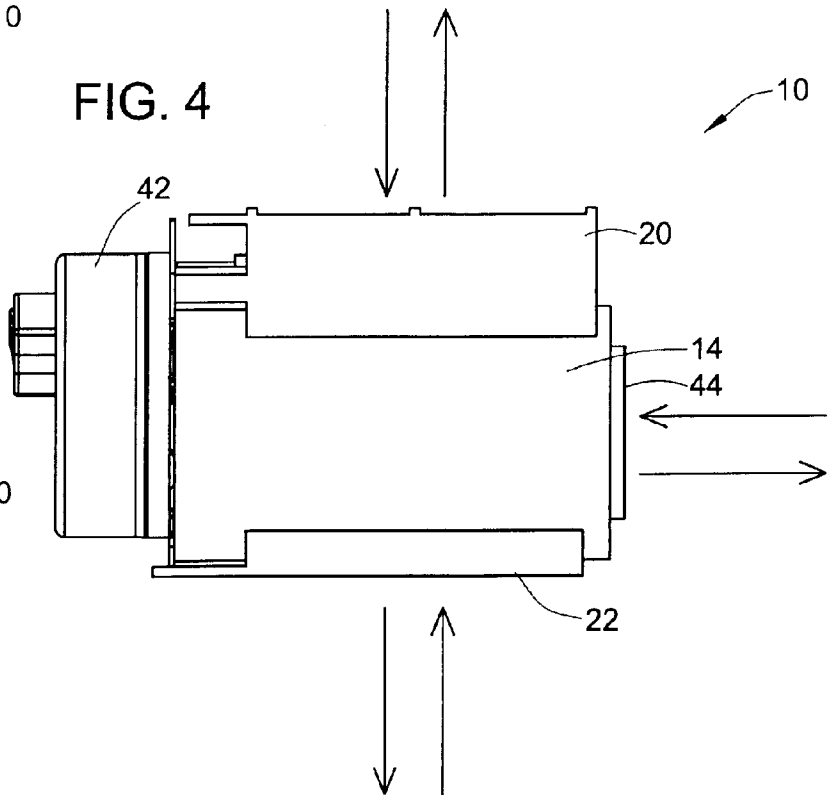
FIG. 4 is a side view illustration of the embodiment of the rotary damper of FIG. 3.

The selectable flow control provided by the flow through rotary air damper of the present invention, and in particular with regard to the embodiment of the present invention illustrated in FIG. 4 will now be described with reference to the simplified fluid flow diagrams of FIGS. 5*a–c*. In these figures, simplified schematic representations of the cylindrical inner and outer body members are used to facilitate the understanding of their operation. Also for ease of illustration, the relative positioning of the apertures in the outer and inner cylindrical body members have been repositioned from that illustrated in FIG. 3. Additionally, a dot has been placed on the end wall of the cylindrical inner body member 24 to provide a reference orientation for the following discussion.

Figure 5A:
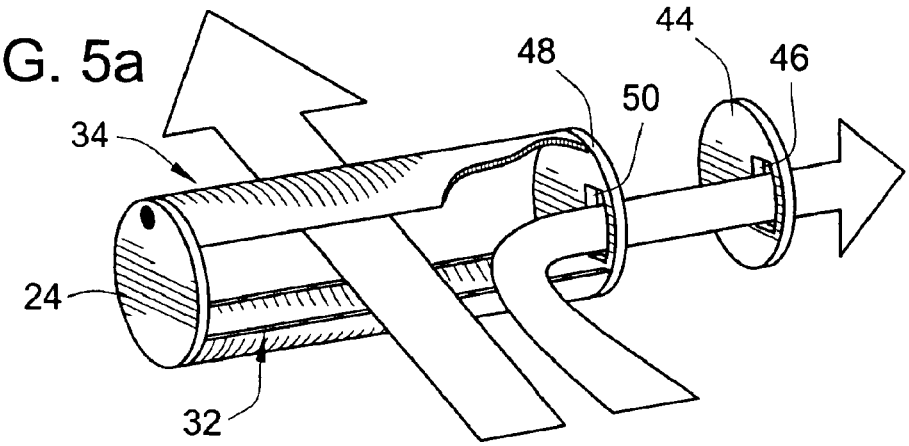
FIG. 5*a-c* are simplified fluid flow diagrams illustrating fluid flow paths through the embodiment of the rotary damper of FIG. 3 in each of its selectable flow path positions.

FIG. 5*a* illustrates an orientation of the cylinder inner body member 24 relative to the cylindrical outer body member 14 that provides for fluid transfer between, for example, the freezer compartment, the fresh food compartment, and a chiller drawer on a multi-compartment refrigerator. The cylindrical inner body member 24 is driven to this relative position when both the main fresh food compartment and the chiller drawer require cooling from the freezer compartment. As will be understood by those skilled in the art, the relative sizing of the apertures 32, 34 in relation to the aperture 50 allows the proper amount of chilled air to flow into the various compartments in relation to their size and overall cooling requirements. In this way, the chiller drawer is not overcooled to the point where damage to the fruits and vegetables typically stored therein will occur.

Figure 5B:
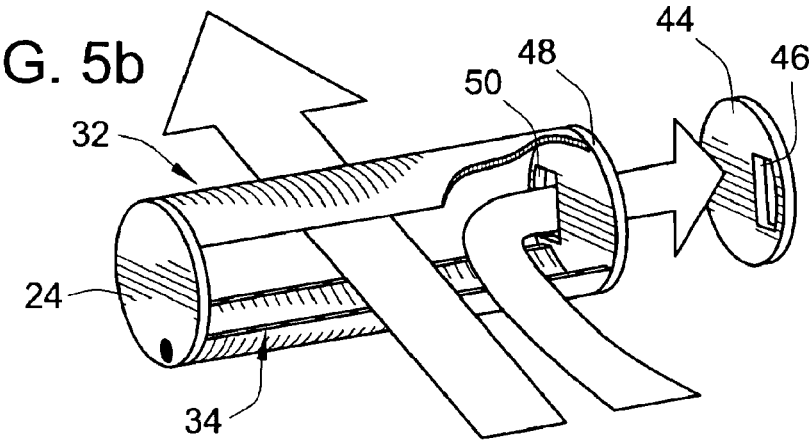
Figure 5C:
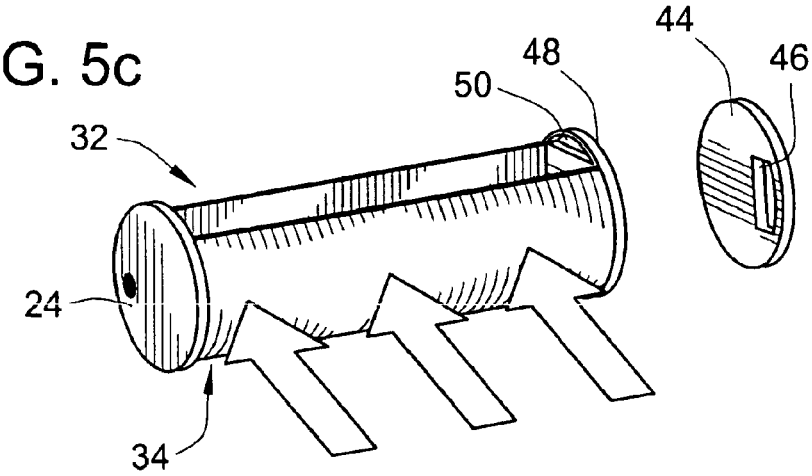

In an exemplary installation in a refrigerator having a freezer compartment, a main fresh compartment, and a chiller drawer or compartment that is sealed within the main fresh food compartment, the orientation of the cylindrical inner body member 24 relative to the cylindrical outer body member 14 will typically be as illustrated in FIG. 5*b* after the main fresh food compartment has called for cooling. That is, the relative orientation illustrated in FIG. 5*b* will occur most often after the refrigerator door has been opened and the temperature within the main fresh food compartment has risen. Since the chiller compartment is not typically opened during most entries into the refrigerator, only the main fresh food compartment may require cooling, the chilled air inside of the chiller compartment not having been allowed to escape while the compartment remained closed during the main fresh food compartment entry. In such a case, the cylindrical inner body member 24 is rotated relative to the cylindrical outer body member 14 such that the apertures 34, 32 align with the apertures 16, 18. However, since the chiller compartment does not require cooling, the aperture 50 is not aligned with the aperture 46 to prevent the flow of chilled air therethrough.

When no compartment requires cooling, the cylindrical inner body member 24 is rotated until the apertures 32, 34 are no longer in alignment with apertures 16, 18 of the cylindrical outer body member 14 to block all flow of air through the assembly 10. From the position illustrated in FIG. 5*c,* the cylindrical body member 24 may be rotated 90° in either a clockwise or counterclockwise direction to move directly to one of the two states illustrated in FIG. 5*a* or 5*b.* In an alternate embodiment, the motor 42 merely rotates in a single direction. In such an embodiment, the cylindrical inner body member will be rotated 90° to achieve an orientation as illustrated in either FIG. 5*a* or 5*b,* and an additional 180° to achieve the other.

Figure 6:
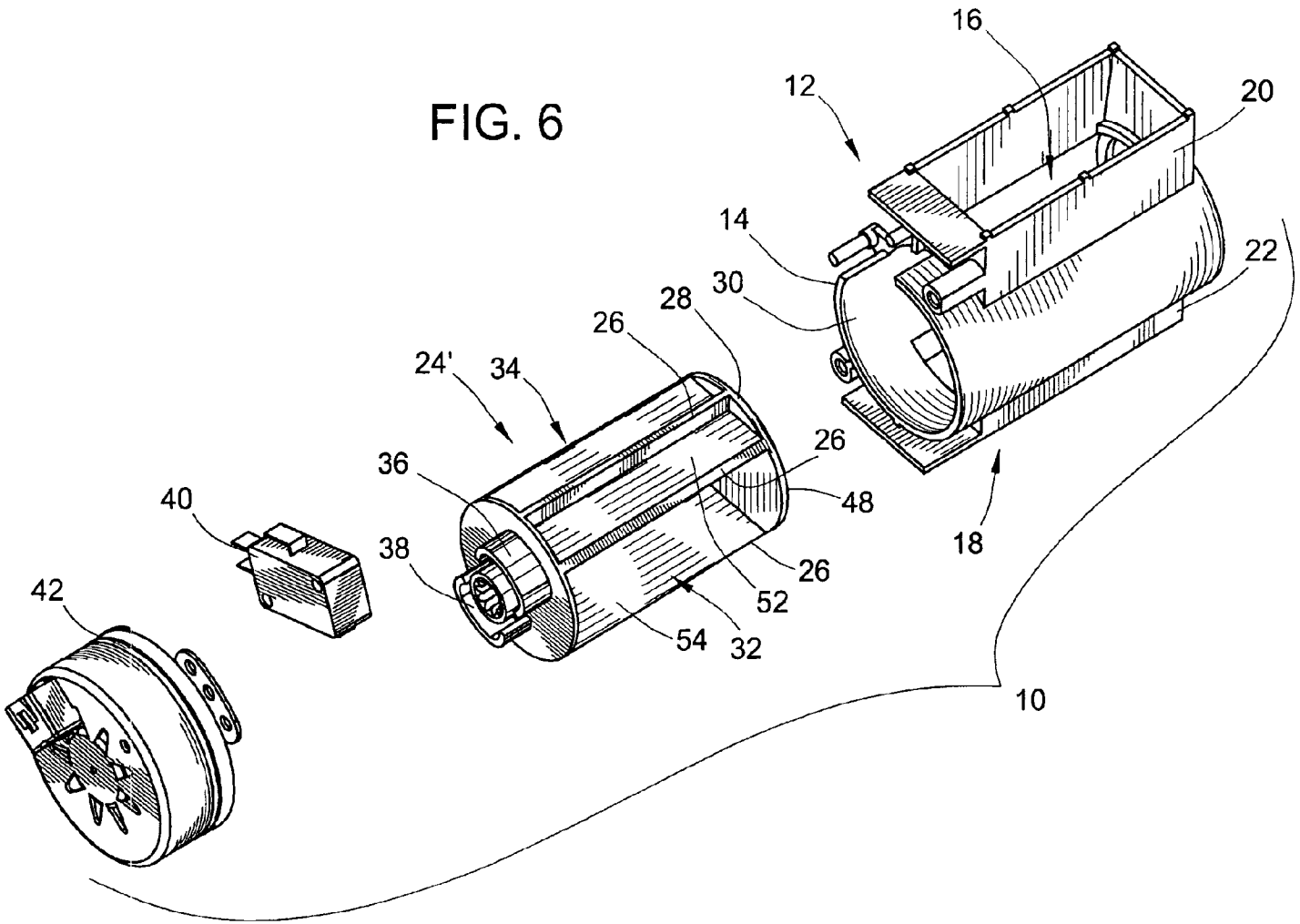
FIG. 6 is an exploded isometric illustration of an alternate embodiment of a flow-through rotary damper constructed in accordance with the teachings of the present invention.

FIG. 6 illustrates an alternate embodiment of the flow through rotary damper assembly 10 of the present invention. While the other components remain essentially unchanged from the previous embodiment, the cylindrical inner body member 24' utilizes an alternate construction that only increases the efficiency of the fluid transfer therethrough by ensuring essentially laminar flow between apertures 32 and 34, but also provides selective cooling control that allows each of the fresh food compartment and the chiller compartment to be cooled separately, or in combination. Each of these additional features are made possible by including planar fluid guide walls 52, 54 to form the flow through conduit between apertures 32, 34. Additionally, another aperture 56 (see FIGS. 7*a–d*) is included in the end wall 48 of the cylindrical inner body member 24'.

Figure 7A:
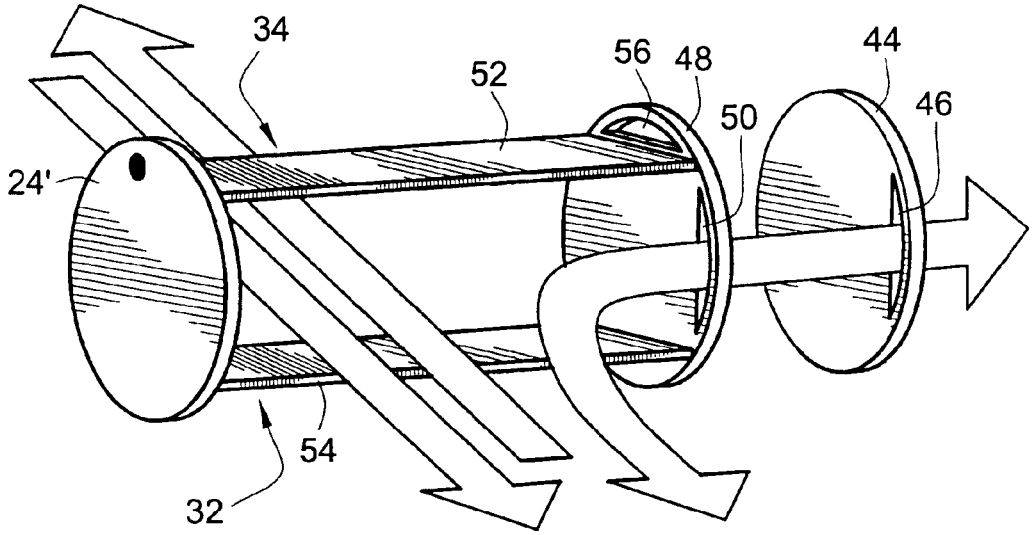
FIGS. 7*a–d* are simplified fluid flow diagrams illustrating fluid flow paths through the embodiment of the rotary damper of FIG. 6 in each of its selectable flow path positions.

Turning now to the flow illustrations of FIGS. 7*a–d,* the description of the selectable cooling provided by this embodiment will be described. As illustrated in FIG. 7*a,* when both the fresh food compartment and the chiller compartment require cooling, the cylindrical inner body member 24' is rotated relative to the cylindrical outer body member 14 such that cool air may flow directly from the freezer compartment into the fresh food compartment in a laminar manner through aperture 32, 34. The aperture 50 and end wall 48 of the cylindrical inner body member 24' is also in alignment with the aperture 46 in the end wall 44 of the cylindrical outer body member 14 such that cool air may also flow from the freezer compartment to the crisper compartment.

Figure 7B:
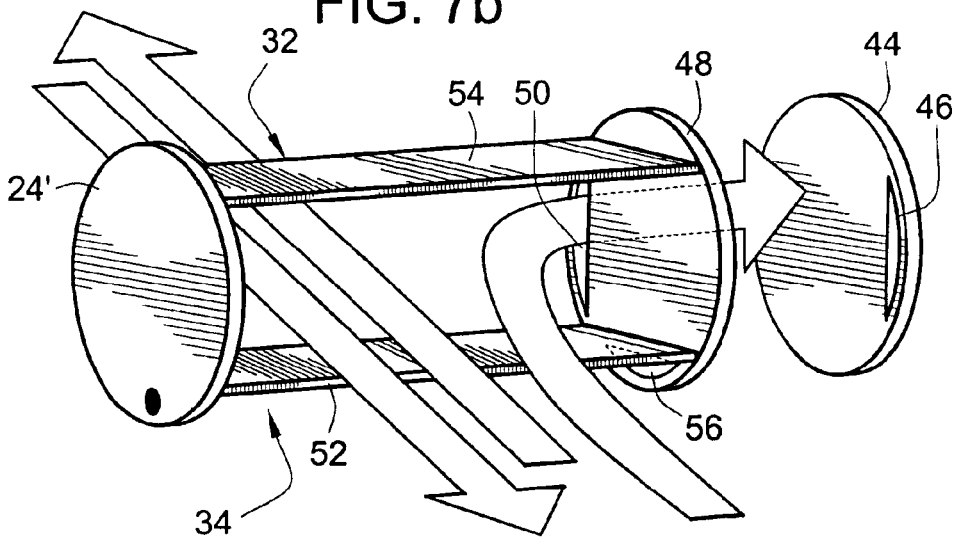

If only the main fresh food compartment of the refrigerator requires cooling, the cylindrical inner body member 24 may be rotated within the cylindrical outer body member 14 such that its orientation is as illustrated in FIG. 7*b.* As may be seen from this illustration, cool air is allowed to flow between the freezer compartment and the main fresh food compartment in a laminar highly efficient manner through apertures 34, 32. However, air flow into the chiller compartment is blocked as aperture 50 of end wall 48 does not align with aperture 46 of end wall 44 leading to the chiller compartment. In this way, highly efficient thermal transfer may occur to the fresh food compartment to return its temperature to the desired level without over chilling the fruits and vegetables or other items typically stored in the chiller compartment if the temperature therein has not risen above its cooling requirement set point. It is noted that this will be the typical configuration of the flow through rotary damper of the present invention after a typical entry into the fresh food compartment during which the chiller compartment was not opened.

Figure 7C:
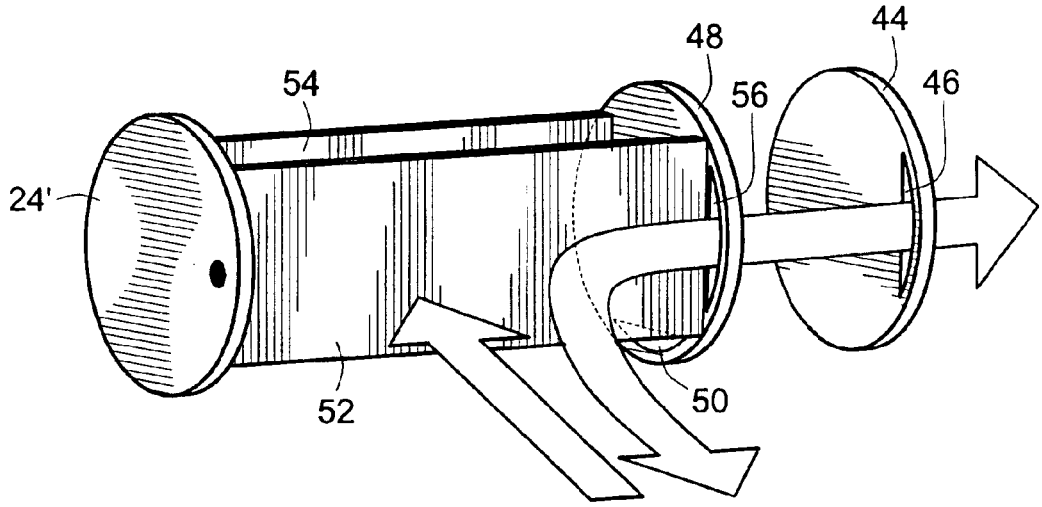

If the chiller compartment temperature were to rise above its temperature set point, the cylindrical inner body member 24' would be rotated relative to the cylindrical outer body member to a position as illustrated in FIG. 7*c.* In this orientation, the flow of cool air from the freezer compartment to the main fresh food compartment is blocked by the fluid guide walls 52, 54. However, this orientation places the aperture 56 of end wall 48 in alignment with aperture 46 of end wall 44 leading to the chiller compartment. As such, the flow of cold air may occur therethrough to return the chiller compartment to its desired set point temperature.

Figure 7D:
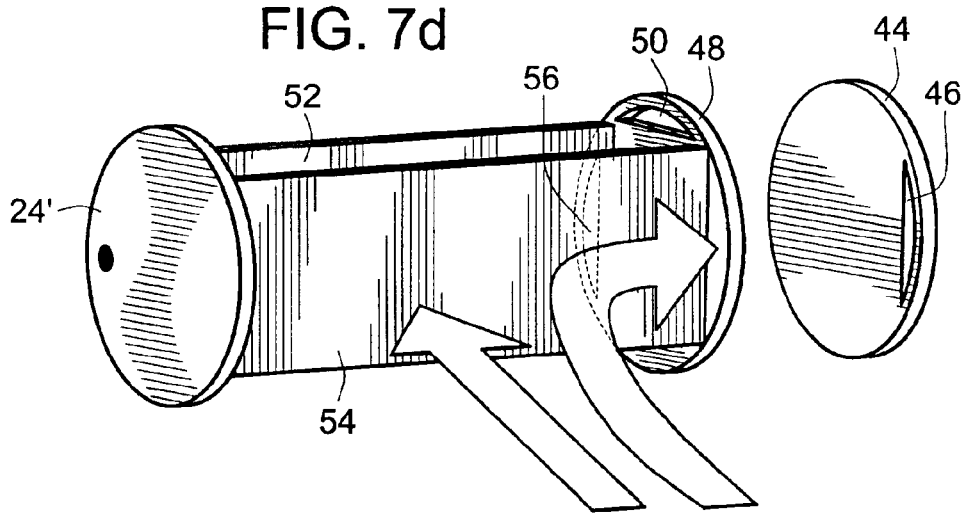

If neither of the fresh food compartments require cooling, the cylindrical inner body 24' is rotated in relation to the cylindrical outer body member 14 until its orientation is as illustrated in FIG. 7*d.* In this orientation, flow of fluid from the freezer compartment to the main fresh food compartment is blocked by the fluid guide walls 54, 52, while the flow of fluid from the freezer compartment to the chiller compartment is blocked by end wall 48.

As will be apparent to those skilled in the art from the preceding discussion, the embodiment of the present invention illustrated in FIG. 6 provides highly efficient and selectable cooling of either the fresh food compartment, the chiller compartment, or both at the same time. Further, the flow of fluid through the embodiment of FIG. 6 is particularly efficient between the freezer and main fresh food compartment as such fluid flow is essentially laminar between the two fluid guide walls 52, 54.

Figure 8:
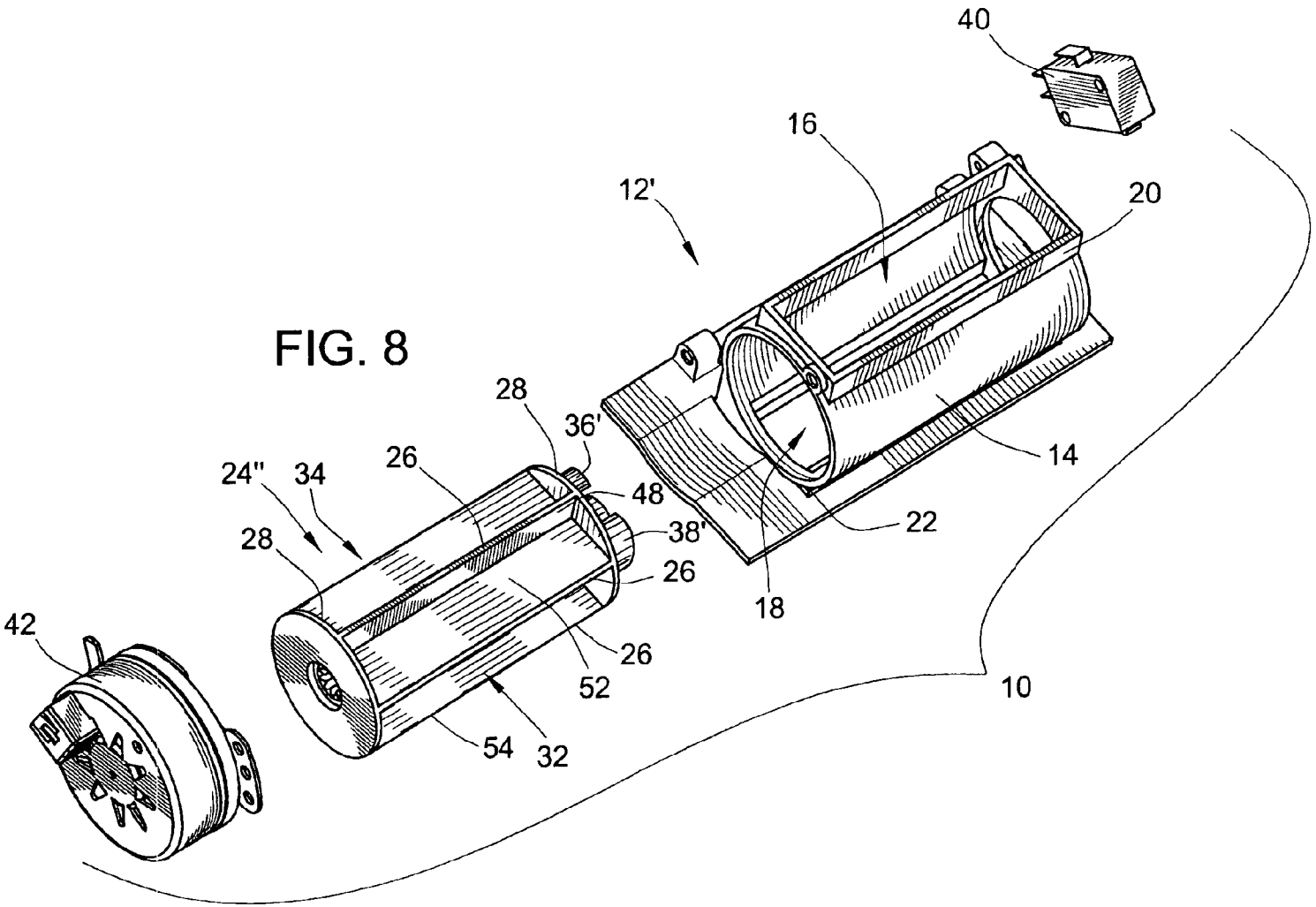
FIG. 8 is an exploded isometric illustration of a further alternate embodiment of a flow-through rotary damper constructed in accordance with the teachings of the present invention.

A further alternate embodiment of the flow through rotary air damper 10 of the present invention is illustrated in FIG. 8. In this embodiment, the cylindrical inner body member 24" provides the location control cam surfaces 36, 38 on end wall 48, opposite the motor 42. As such, the microswitch 40 is positioned opposite the motor 42 as well. The housing 12' of this embodiment also differs from previous embodiments in that both ends of the cylindrical outer body member 14 are open. This is to accommodate the insertion of the cylindrical inner body member 24 and to allow the location control cam surfaces 36, 38 to be sensed at the opposite end. The fluid flow sealing is still provided by the longitudinal fluid sealing members 26 and the circumferential fluid sealing members 28 within the cylindrical outer body member 14.

Figure 10:
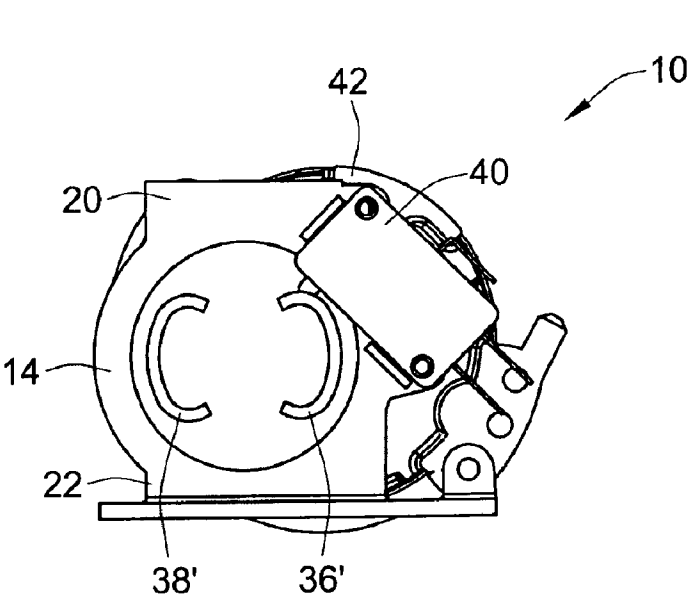
FIG. 10 is an end view illustration of the embodiment of the rotary damper of FIG. 8.
Figure 9:
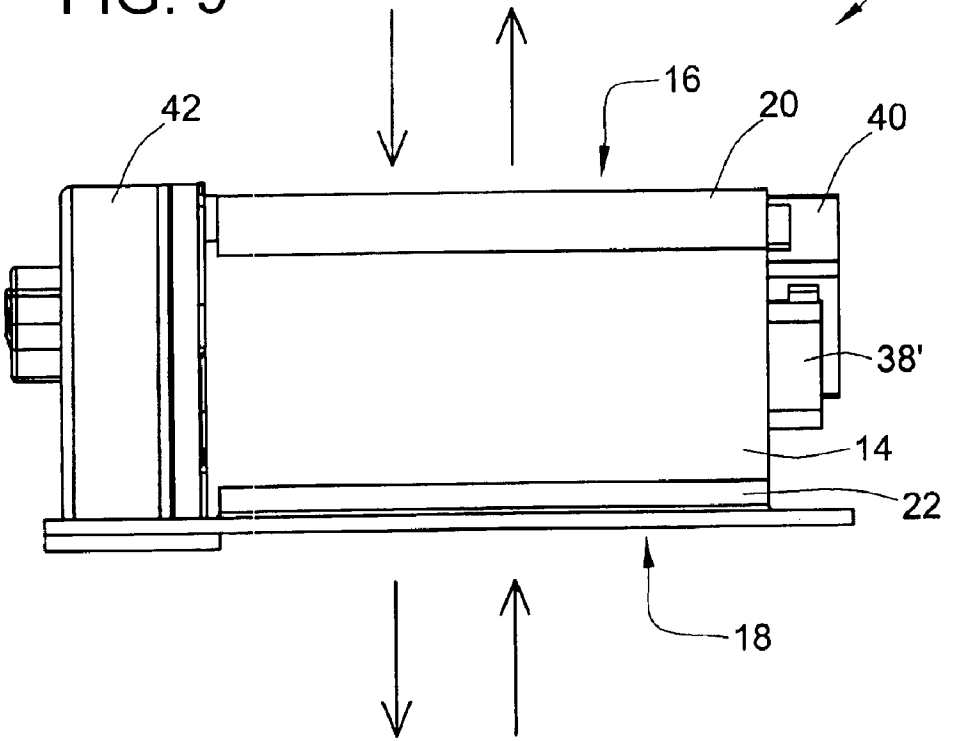
FIG. 9 is a side view illustration of the embodiment of the rotary damper of FIG. 8.

Fluid flow through this embodiment of the flow through rotary damper 10 is illustrated in FIG. 9. As may be seen from this side view illustration, this embodiment is particularly well suited for fluid transfer between two compartments in a compact location. As with the previous embodiment, the fluid flow through this embodiment is particularly efficient as the flow is essentially laminar therethrough. That is, the fluid flow is straight through the rotary damper 10 without any turns in the flow path. As may be seen from the end view of FIG. 10, fluid flow into a third compartment is not provided in this embodiment. Instead, this end of the assembly 10 is used to provide the positional sense of the cylindrical inner body member 24" in relation to the stationary cylindrical outer member 14.

Figure 11:
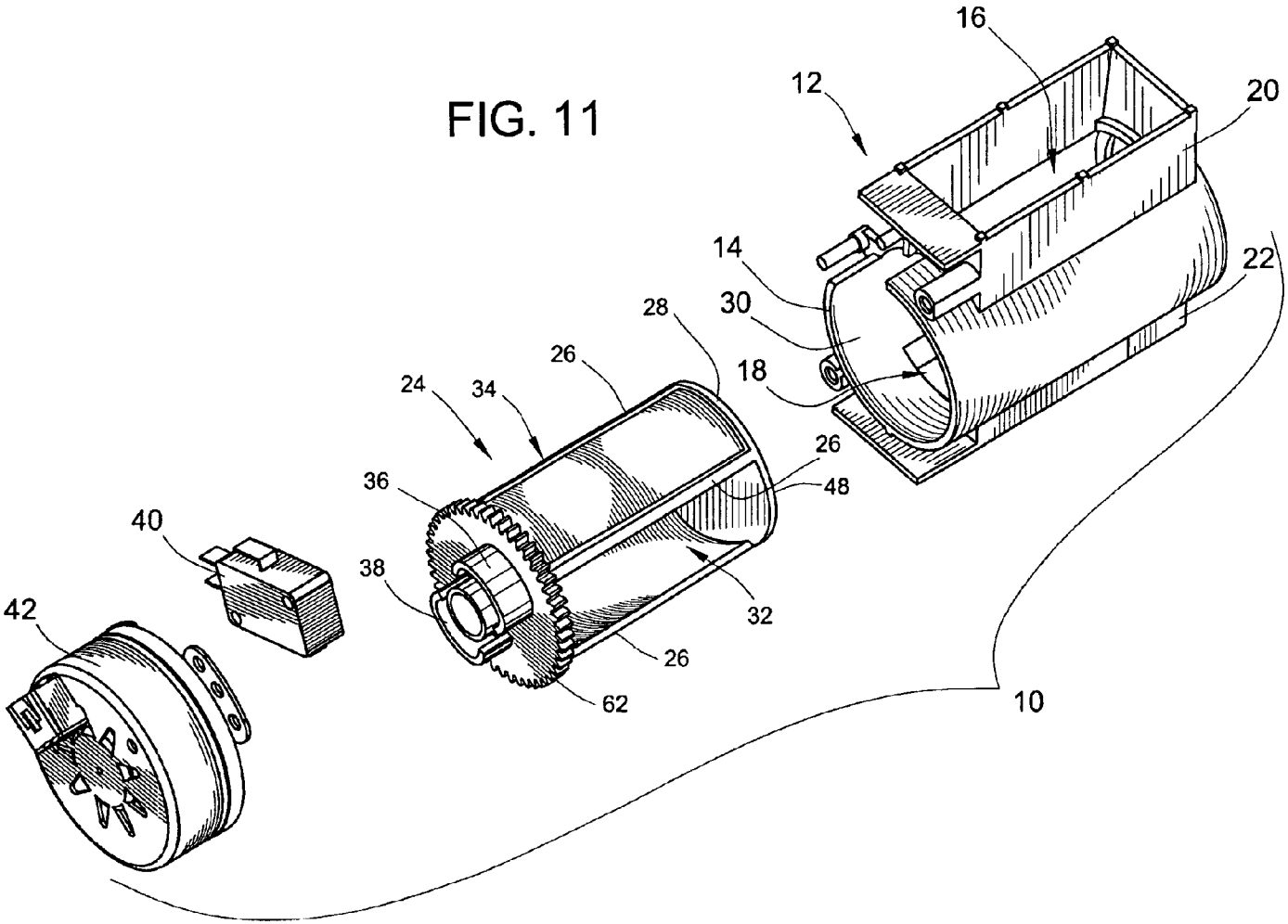
FIG. 11 is a partial isometric illustration of a still further alternate embodiment of the present invention.

A further alternate embodiment is illustrated in FIG. 11. In this embodiment of the present invention, the drive coupling from the motor 42 drivingly engages teeth 62 on the end ring of the cylindrical inner body member 24. It should be noted that this driving arrangement may be utilized with any other preceding embodiments.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claim is:

1. A flow-through rotary damper assembly, comprising:

a cylindrical outer body member defining a first aperture and a second aperture in an outer wall thereof, the first and the second apertures being formed in radial proximity with one another on opposite sides of the cylindrical outer body member;

a cylindrical inner body member rotatably positioned within the cylindrical outer body member, the cylindrical inner body member defining a third aperture and a fourth aperture in an outer wall thereof, the third and fourth apertures being formed in radial proximity with one another on opposite sides of the cylindrical inner body member; and wherein a radial flow path straight through the assembly is formed when the cylindrical inner body member is rotationally positioned such that the third and fourth apertures are aligned with the first and the second apertures.

2. The flow-through rotary damper assembly of claim 1, further comprising an inlet plenum and an outlet plenum coupled to the cylindrical outer body member in proximity to the first aperture and the second aperture to direct fluid communication therethrough.

3. The flow-through rotary damper assembly of claim 1, further comprising a rotational position sensing mechanism positioned to sense a rotary position of the cylindrical inner body member.

4. The flow-through rotary damper assembly of claim 3, wherein the cylindrical inner body member includes at least one location control cam surface, and wherein the rotational position sensing mechanism comprises a microswitch operatively positioned in relation to and actuated by the at least one location control cam surface.

5. The flow-through rotary damper assembly of claim 4, wherein the at least one location control cam surface is positioned on an end wall of the cylindrical inner body member opposite a driving end wall adapted to be driven by a source of motive power.

6. The flow-through rotary damper assembly of claim 1, further comprising a source of motive power drivably coupled to the cylindrical inner body member.

7. The flow-through rotary damper assembly of claim 6, wherein the source of motive power is a timer motor that is operative to rotate the cylindrical inner body member for a predetermined period of time to position the third and the fourth apertures at a desired rotational position relative to the first and the second apertures.

8. The flow-through rotary damper assembly of claim 1, wherein flow of fluid through the assembly is precluded when the cylindrical inner body member is positioned such that the third and fourth apertures are not in alignment with the first and the second apertures.

9. The flow-through rotary damper assembly of claim 8, wherein the cylindrical inner body member further includes fluid sealing members on an outer surface thereof, the fluid sealing members operative in relation to an inner surface of the cylindrical outer body member to preclude fluid flow between the outer surface of the cylindrical inner body member and the inner surface of the cylindrical outer body member.

10. The flow-through rotary damper assembly of claim 9, wherein the fluid sealing members include longitudinal fluid sealing members and circumferential fluid sealing members.

11. The flow-through rotary damper assembly of claim 1, wherein the cylindrical outer body member further defines a fifth aperture in an end wall thereof, wherein the cylindrical inner body member further defines a sixth aperture in an end wall thereof, and wherein an axial flow path out of the assembly is formed when the sixth aperture is positioned in alignment with the fifth aperture.

12. The flow-through rotary damper assembly of claim 11, wherein the fifth aperture is positioned in one half of the end wall of the cylindrical outer body member and wherein the sixth aperture is poisoned in one half of the end wall of the cylindrical inner body member such that alignment of the first aperture with the third aperture results in alignment of the fifth aperture with the sixth aperture to form the axial flow path.

13. The flow-through rotary damper assembly of claim 12, wherein alignment of the first aperture with the fourth aperture results in the fifth aperture not being aligned with the sixth aperture thereby precluding axial fluid flow.

14. The flow-through rotary damper assembly of claim 12, wherein non-alignment of the first and second apertures with the third and fourth apertures precludes both radial and axial fluid flow through the assembly.

15. The flow-through rotary damper assembly of claim 11, wherein the cylindrical inner body member includes two fluid guide walls forming the third and the forth apertures and a fluid flow path therebetween, wherein the fifth aperture is positioned in one half of the end wall of the cylindrical outer body member and wherein the sixth aperture is poisoned in one half of the end wall of the cylindrical inner body member in the fluid flow path such that alignment of the first aperture with the third aperture results in alignment of the fifth aperture with the sixth aperture to form the axial flow path and such that alignment of the first aperture with the fourth aperture results in the fifth aperture not being aligned with the sixth aperture thereby precluding axial fluid flow.

16. The flow-through rotary damper assembly of claim 15, wherein the cylindrical inner body member further defines a seventh aperture in the end wall thereof positioned outside of the fluid flow path such that rotation of the cylindrical inner body member to a first position to preclude radial flow through the assembly aligns the seventh aperture with the fifth aperture allowing fluid flow through the first aperture and the aligned fifth and seventh apertures, and wherein rotation of the cylindrical inner body member to a second position to preclude radial flow through the assembly also precludes axial flow through the assembly.

17. The flow-through rotary damper assembly of claim 16, wherein the first position and the second position are displaced one from the other by approximately 180 degrees.

18. The flow-through rotary damper assembly of claim 15, wherein the fluid guide walls are plainer such that the fluid flow path defined therebetween allows for essentially laminar fluid flow through the assembly.

19. A flow-through rotary damper assembly for use in a refrigerator having at least a freezer compartment and a main fresh food compartment, the assembly comprising:

a cylindrical outer body member defining a first aperture adapted to accommodate fluid communication with the freezer compartment and a second aperture adapted to accommodate fluid communication with the fresh food compartment, the first and the second apertures being positioned to allow radial fluid flow through the first aperture and the second aperture without requiring a fluid flow direction change therein;

a cylindrical inner body member rotatably positioned within the cylindrical outer body member, the cylindrical inner body member defining a third aperture and a fourth aperture, the third and fourth apertures being positioned to allow radial fluid flw through the third aperture and the fourth aperture without requiring a fluid flow direction change therein; and wherein a radial flow path through the assembly is formed when the cylindrical inner body member is rotationally positioned such that the third and fourth apertures are aligned with the first and the second apertures such to accommodate air flow at least between the freezer compartment and the main fresh food compartment without requiring a fluid flow direction change within the assembly.

20. The flow-through rotary damper assembly of claim 19 for use in a refrigerator additionally having a crisper compartment, wherein the cylindrical outer body member further defines a fifth aperture in an end wall thereof adapted to accommodate fluid communication with the crisper compartment, wherein the cylindrical inner body member further defines a sixth aperture in an end wall thereof, and wherein an axial flow path out of the assembly is formed when the sixth aperture is positioned in alignment with the fifth aperture such that at least the freezer compartment and the crisper compartment are in fluid communication.

21. The flow-through rotary damper assembly of claim 20, wherein the fifth aperture and the sixth aperture are positioned such that alignment of the first aperture with the third aperture results in alignment of the fifth aperture with the sixth aperture to accommodate air flow between the freezer compartment, the main fresh food compartment, and the crisper compartment.

22. The flow-through rotary damper assembly of claim 21, wherein alignment of the first aperture with the fourth aperture results in the fifth aperture not being aligned with the sixth aperture to accommodate air flow between the freezer compartment and the main fresh food compartment while precluding air flow to the crisper compartment.

23. The flow-through rotary damper assembly of claim 22, wherein non-alignment of the first and second apertures with the third and fourth apertures precludes air flow between the freezer compartment, the main fresh food compartment, and the crisper compartment.

24. The flow-through rotary damper assembly of claim 20, wherein the cylindrical inner body member includes two fluid guide walls forming the third and the forth apertures and a fluid flow path therebetween, and wherein the sixth aperture is poisoned in the fluid flow path such that alignment of the first aperture with the third aperture results in alignment of the fifth aperture with the sixth aperture to accommodate air flow between the freezer compartment, the main fresh food compartment, and the crisper compartment.

25. The flow-through rotary damper assembly of claim 24, wherein alignment of the first aperture with the fourth aperture results in the fifth aperture not being aligned with the sixth aperture to accommodate air flow between the freezer compartment and the main fresh food compartment and to preclude air flow to the chiller compartment.

26. The flow-through rotary damper assembly of claim 25, wherein the cylindrical inner body member further defines a seventh aperture in the end wall thereof positioned outside of the fluid flow path such that rotation of the cylindrical inner body member to a first position to preclude air flow between the freezer compartment and the main fresh food compartment aligns the seventh aperture with the fifth aperture to accommodate air flow between the freezer compartment and the crisper compartment.

27. The flow-through rotary damper assembly of claim 26, wherein rotation of the cylindrical inner body member to a second position to preclude air flow between the freezer compartment and the main fresh food compartment also precludes air flow between the freezer compartment and the crisper compartment.

28. The flow-through rotary damper assembly of claim 20, wherein the cylindrical inner body member includes two fluid guide walls forming the third and the forth apertures and a fluid flow path therebetween, and wherein the sixth aperture is positioned outside of the fluid flow path such that rotation of the cylindrical inner body member to a first position to preclude air flow between the freezer compartment and the main fresh food compartment aligns the sixth aperture with the fifth aperture to accommodate air flow between the freezer compartment and the crisper compartment.

29. The flow-through rotary damper assembly of claim 19, wherein the cylindrical inner body member includes two plainer fluid guide walls forming the third and the forth apertures and a fluid flow path therebetween such that the fluid flow path defined therebetween allows for essentially laminar air flow through the assembly.

30. A flow-through rotary damper assembly, comprising:

a cylindrical outer body member defining a first aperture and a second aperture in an outer wall thereof, the first and the second apertures being formed in radial proximity with one another on opposite sides of the cylindrical outer body member;

a cylindrical inner body member rotatably positioned within the cylindrical outer body member, the cylindrical inner body member including two plainer fluid guide walls forming a third and a forth apertures and a fluid flow path therebetween such that the fluid flow path defined therebetween allows for essentially laminar air flow through the cylindrical inner body member; and wherein a flow path through the assembly is formed when the cylindrical inner body member is rotationally positioned such that the third and fourth apertures are aligned with the first and the second apertures, the flow path having a radial inlet and a radial outlet.

* * * * *